United States Patent [19]

Payne et al.

[11] 4,151,993

[45] May 1, 1979

[54] ENERGY SAVING CONTROL SYSTEM FOR AN AUTOMATIC PIN SPOTTER

[75] Inventors: Donald J. Payne, La Palma, Calif.; Richard E. Hart, Los Angeles, Calif.; Francis A. Ksiazek, Westminster, Calif.

[73] Assignee: Energy Miser Systems Inc., Garden Grove, Calif.

[21] Appl. No.: 859,961

[22] Filed: Dec. 12, 1977

[51] Int. Cl.[2] ..... A63D 5/00

[52] U.S. Cl. ..... 273/43 A; 273/54 R

[58] Field of Search ..... 273/43 R, 43 A, 54 R

[56] References Cited

U.S. PATENT DOCUMENTS

| | | | |
|---|---|---|---|
| 3,237,942 | 3/1966 | Congelli et al. | 273/43 R |
| 3,240,493 | 3/1966 | Cohen | 273/43 A X |
| 3,889,947 | 6/1975 | Short | 273/43 A |

*Primary Examiner*—Anton O. Oechsle

[57] ABSTRACT

A control system for an automatic pin spotter which permits the drive motor of the pin spotter to run only when needed so that energy is not wasted in the needless running of the motor and other portions of the pin spotter. The control system includes means for sensing when the pin spotter has a pin deck that is full of pins, sensing when the pin spotter is going through a pin spotting cycle and sensing whether a ball is in the pin spotter. The motor is allowed to run if the pin deck is not full, if there is a pin spotter cycle in progress, and if the bowling ball is in the pin spotter and otherwise it is turned off.

12 Claims, 2 Drawing Figures

ENERGY SAVING CONTROL SYSTEM FOR AN AUTOMATIC PIN SPOTTER

BACKGROUND OF THE INVENTION

Automatic pin spotters for bowling centers have greatly reduced the labor required to operate a bowling center and due to their speed and precision in large measure have contributed to the popularity of bowling as a sport. Basically, an automatic pin spotter consists of a large electric motor which drives a cyclic pin spotter mechanism, a mechanism to lift pins into a deck above the alley where the pins are available for setting by the pin spotter mechanism and a ball return mechanism. The pin spotter mechanism clears the alley and replaces the pins in the proper positions as a result of a ball hitting the back cushion of the alley, or the actuation of an electric control. Pin spotters mechanisms do not run continuously, but run through a fill cycle which includes a pin pick up when required, alley sweep, and pin replacement and then stop. This action is controlled by a clutch which is caused to engage by the ball striking the back cushion or the electrical control and remains engaged until the pin spotter has completed a full cycle.

As the cost of electrical energy has gone up with rising energy costs and the availability of electrical energy for recreational purposes has diminished, especially during the summer, there has been a need to reduce the power consumption of bowling centers. In most bowling centers, the automatic pin spotting machines consume a large amount of power and, therefore, there has been a need to reduce the power required by such machines. In addition, if the energy consumption of such machines is reduced, they produce less heat so a proportionate reduction in airconditioning cost can be realized in the summer. Since pin spotter machines are expensive and are designed for a long life, there is need for an energy saving device which can be adapted economically to presently existing and installed machines.

SUMMARY OF THE INVENTION

The present invention can be used to convert a continuously running automatic pin spotting machine to a function/run-on-demand machine, that is, the motor only is on when there is a demand for mechanical energy and at other times the motor is off. This accomplished by the addition of four switches at convenient places in pin spotter machine and appropriate relays or solid controls the respond to the positions of the switches with predetermined logic. First there is a deck filler switch which is positioned adjacent a lever present in pin spotting machines which moves in a predetermined manner to mechanically indicate when deck is full of bowling pins. The deck filler switch is used to assure that the motor runs any time there is an empty deck for a bowling pin. The second switch is a full cycle switch which is positioned for movement to the pin spotter clutch engagement mechanism. When the clutch is engaged by the bowling ball hitting the back cushion or by a solenoid controlled by a pushbutton switch, the full cycle switch is closed to start the motor which starts and assures completion of the pin spotting cycle. When the clutch disengages at the end of a cycle, the full cycle switch opens and no longer causes the motor to run. When a ball hits the back ball cushion to engage the clutch, an actuator switch associated therewith is momentarily closed to energize a latching relay. The latching relay causes the motor to run until a ball switch located on the ball return is opened by the passage of the bowling ball to unlatch the latching relay. Additionally, a bypass switch can be included in the control so that the motor can be caused to run continuously no matter what the condition of the four aforementioned switches.

The net result is that the motor only runs when there is a demand for mechanical energy and is off at all other times. Tests have shown that in open play and normal league play, up to a forty percent energy saving can be accomplished when continuously running pin spotter machines are compared with identical running pin spotter machines are compared with identical machines having the present saving control. As a side benefit, the noise within the bowling centers is reduced and the mechanical wear on the pin spotting machines, especially high wear out parts such as clutch discs is decreased.

It is, therefore, a primary object of the present invention to reduce the power requirements of bowling centers employing continuously operating automatic pin spotter machines without introducing delays in the bowling or pinspotter cycle.

Another object is to provide an energy saving control for automatic pin spotting machine which can be quickly and easily installed at a reasonable cost and without requiring excessive machine downtime.

Another object is to provide an energy saving control which is inherently simple so that it does not induce reliability problems into an automated pin spotter.

Another object of the present invention is to provide an energy saving control for pin spotter machines which requires little mechanical modification to the basic machine.

Another object is to reduce the mechanical wear of certain normally continuously operating pin spotter parts and clutch discs which normally have high initial torque and friction wear upon engagement.

Another object is to provide the aforementioned control in a way that can be instantly bypassed in case there is a problem in the control or if a continuously running pin spotter machine is desired.

These and other objects and advantages of the present invention will become apparent to those skilled in the art after considering the following detailed specification which covers a preferred embodiment thereof in conjunction with the accompanying drawing wherein:

FIG. 1 is a simplified block diagram of an automatic pin spotting machine showing diagramatically the present invention as added thereto; and FIG. 2, is a schematic diagram of the energy saving control of the present invention.

DETAILED DESCRIPTION OF THE SHOWN EMBODIMENT

Figure 1:
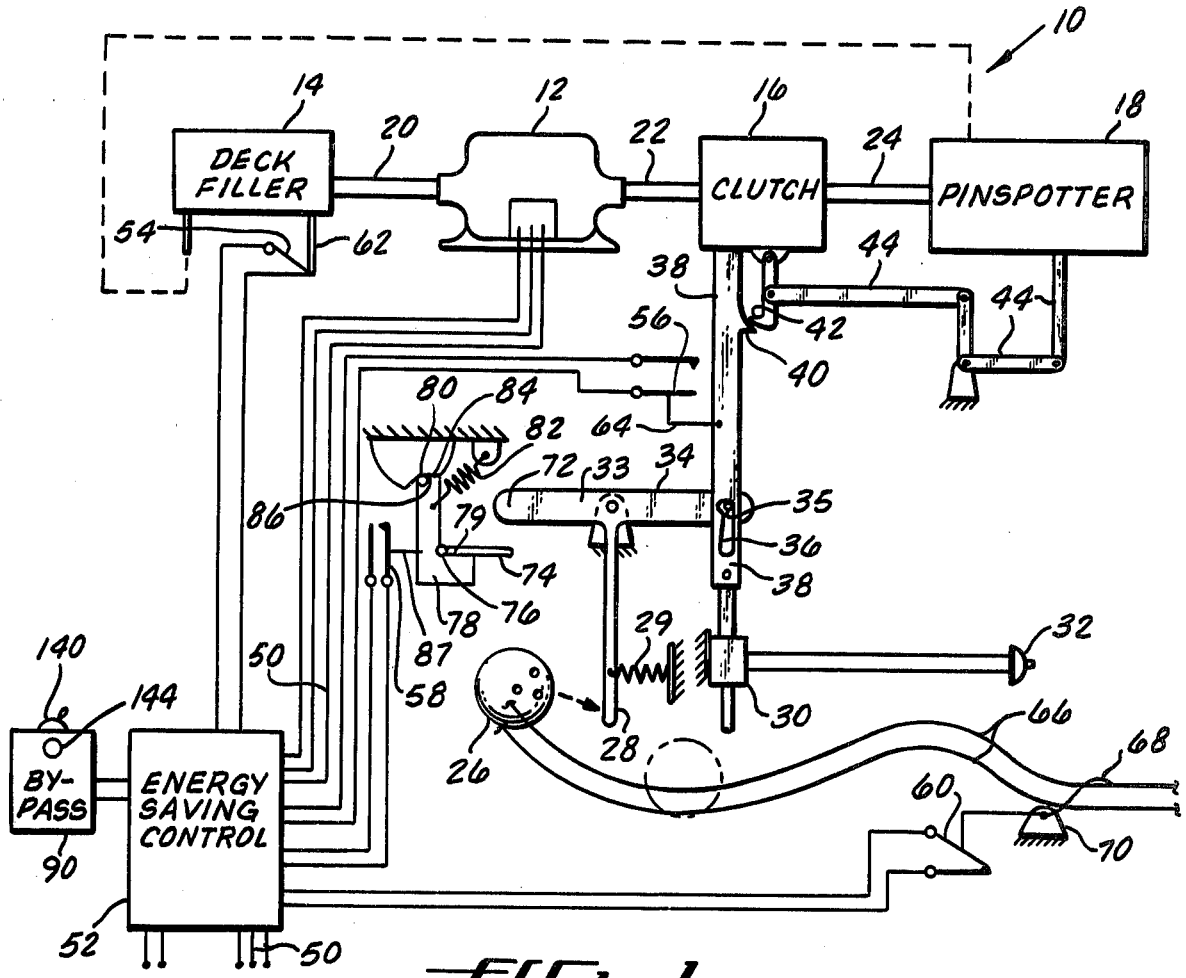

Referring to the drawing more particularly by reference numbers, number 10 in FIG. 1, refers to automatic pin spotting machine whose main components are shown in block diagram as being a motor 12, a pin deck and filler mechanism 14, a clutch 16 and a pin spotter 18. The motor 12, when energized rotates mechanical energy transmission means which are shown as drive shafts 20 and 22 for convenience. The shafts 20 and 22 feed mechanical energy to the deck filler 14 and the clutch 16 respectively. In machines, such as the Brunswick, Model A, the motor 12 drives the deck filler 14 continuously to assure that the deck of the pin spotter 18 always has a full capacity of pins for setting by the pin spotter during the bowling game. It is not desirable that the pin spotter 18 continuously cycle since such would make the game impossible, so the drive shaft 22 from the motor 12 is connected to a clutch 16 which when engaged drives the pin spotter 18 through another drive shaft 24. The clutch 16 is mechanically engaged either by action of a bowling ball 26, hitting the back cushion 28 of the bowling alley and compressing a shock absorbing spring 29 or by means of the solenoid 30, which is controlled by a suitable switch 32. For simplicity sake, the back cushion 28 is shown as the leg of a T-shape lever 33, the upward motion of one arm 34 of which is connected by means of a pin 35 in a slot 36 of link 38 to engage the clutch 16 when the lever 33 is rotated in a counterwise direction. Clutches, such as clutch 16, are designed to latch once engaged, and this is shown diagramatically by the opposite facing pawls 40 and 42 which engage when the link 38 is moved upwardly to keep the clutch 16 in an engaged position. The pawl 42 is connected by means of linkage 44 to the pin spotter 18 which causes the pawl 42 to be pulled away from the pawl 40 to disengage the clutch 16 as the in spotting cycle is completed. The exact details of this mechanism are highly complex but are not required for a complete showing of the present invention.

The clutch 16 can also be engaged by actuation of the solenoid 30 which is shown connected to the link 38 and position to move the link 38 upwardly to engage the pawls 40 and 42 without rotation of the lever 33. Heretofore, a conventional automatic pin spotter machine has been described in a simplified manner.

The power lines 50 which energize the motor 12, pass through an energy saving control 52 which responds to outputs from a deck filler switch 54, a clutch engaged or full cycle switch 56, an actuator switch 58 and a ball return switch 60. The switches, 54, 56 and 60 are normally closed while switch 58 is normally open. The normally closed deck filler switch 54 is mechanically opened by a link 62 which is connected to the mechanism in the deck filler 14 which indicates that the deck is full. The switch 56 is opened by a downward motion of link 38 as the clutch 16 is disengaged and closed as the clutch 16 is engaged. It is preferable that the clutch 16 is engaged prior to the closing of switch 56 and disengaged after the opening of switch 56 as this reduces clutch wear. The switch 56 is connected to the link 38 by means of link 64. The ball switch 60 is opened by a ball 26 rolling down the ball return rails 66 and over a lever 68 which in response thereto rocks clockwise about pivot 70 to open the connected switch 60.

The normally open actuator switch 58 is operated by the other arm 72 of the T-shape lever 33. As the lever 33 is rotated counter-clockwise by the ball 26, the arm 72 comes in contact with a paddle link 74 which is hinged by pivot 76 to a second link 78. The paddle link 74 can be oriented with respect to gravity or can be lightly spring loaded to have a stable position in contact with an abutment surface 79 of link 78. The abutment surface contact prevents clockwise rotation of the link 74 about the hinge 76 when the link 74 is in the position shown. The link 78 is hinged by pivot 80 and loaded by spring 82 to the position shown in FIG. 1 with an abutment surface 84 thereof in contact with a stationary abutment surface 86. The link 78 is also connected to the switch 58 by means of link 87 so its motion if any is transferred to the switch 58. The net result of the mechanism just described is that as the lever 33 rotates in a counter-clockwise direction, the switch 58 is momentarily engaged yet as the lever 33 rotates clockwise to the position shown in FIG. 1, the link 74 pivots upwardly to prevent transference of the motion to the switch 58 and the switch 58 is not closed. The link 74 and arm 72 are properly sized so the paddle link 74 drops to the position shown in FIG. 1 as the lever 33 returns to the position shown in FIG. 1. The closing of the switch 58 is used to indicate that a ball has caused the clutch 16 to engage and therefore the motor 12 should run until the ball 26 has been returned, which event is signaled by the opening of the switch 60 as the ball 26 depresses lever 68.

Figure 2:
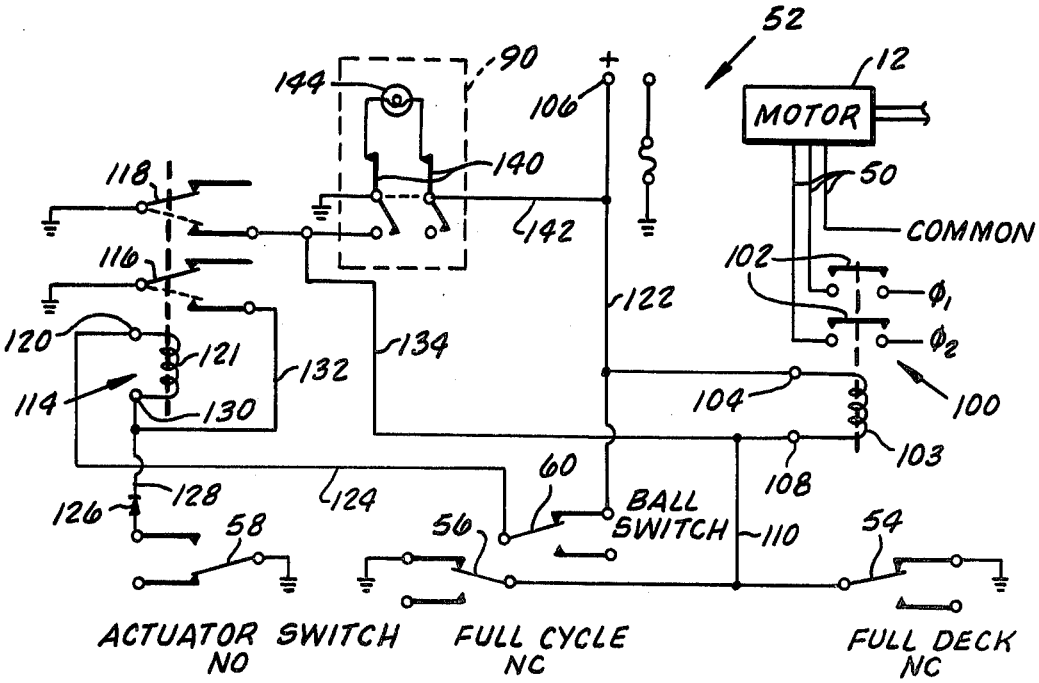

The details of a relay type embodiment of the electrical energy saving control 52 and the bypass 90 therefore, are shown in greater detail in FIG. 2. It should be realized that although conventional relays and switches are shown, solid state relays and logic network can also be employed. The energization of the motor 12 is controlled by a motor relay 100 which when energized pulls down switch contacts 102 to energize the motor 12. The relay 100 includes a coil 103 which is connected at its upper end 104 to a cource 106 of control voltage. The relay 100 is energized any time the opposite end 108 of the coil 103 is grounded so that current flows therethrough. As shown, the normally closed full deck indicating switch 54 grounds the end 108 through line 110. Since the switch 54 only opens when there is a full desk of pins, the motor 12 runs at least until the deck is full, no matter what else happens.

The normally closed full cycle switch 56 also provides a ground to the relay coil end 108 through line 110 whenever the clutch 16 is engaged. This switch is held open by link 64 whenever the clutch 16 is disengaged. Therefore, once a cycle of the pin spotter 18 has started, a ground continues to be applied to the lower end 108 of the relay coil 103 to maintain the motor 12 in an energized condition at least until the cycle is over.

The actuator switch 58 which indicates that a ball has struck the back cushion 28 is momentarily closed by such action as aforesaid to apply a ground to a latching relay 114 which closes a pair of switches 116 and 118 by moving them to the positions shown in dashed outline in FIG. 2. The upper end 120 of the coil 121 of the relay 114 receives control voltage from the source 106 through switch 60 which is normally closed as shown along lines 122 and 124. The momentary closure of the switch 58 applies a ground through the diode 126 and line 128 to the lower end 103 of the relay coil 121 thus causing it to energize and change the position of switches 116 and 118 from the position shown in solid line to the positions shown in dashed outline. The diode 126 is used for isolation.

Since switch 116 thereafter connects the end 130 to ground by means of line 132, the relay 114 latches in an energized condition so long as control voltage is being applied to the upper end 120 of the coil 121 thereof. The switch 118 when closed by the energized relay 114 connects a ground by means of line 134 to the end 108 of the motor control relay coil 103 to keep the motor 12 energized even though the full cycle switch 56 and the full deck switch 54 might already have been opened.

This condition continues until the ball switch 60 is opened. Switch 60 is connected on one side to the control voltage source 106 by line 122 and to the upper end 120 of the relay coil 121 on the other. Therefore, the opening of the ball switch 60 removes the positive control voltage from the relay coil 121 and the relay 114 de-energizes. The opening of switch 60 is caused by a ball returning to the bowler, thus indicating there is no further need for the motor 12 to run just to return the ball and the relay 114 no longer provides the energizing ground for relay 100.

Should something in the control 52 malfunction or for any other reason should it be desired that the motor 12 run continuously, a double pole, double throw switch 140 in the bypass 90 is moved from the position shown wherein control voltage from source 106 is fed on line 142 through an indicator light 144 to ground to a position where line 134 connects a continuous ground to the end 108 of relay coil 103 to energize the relay 100. When this occurs, the motor 12 will run since it runs any time that the relay 100 is energized.

Thus there has been shown and described novel means for economizing the energy required to operate an automatic pin spotter machine which fulfill all the objects and advantages sought therefor. Many changes, modifications, variations and other uses and applications of the subject invention will, however, become apparent to those skilled in the art after considering this specification together with the accompanying drawing. All such changes, modifications, variations and other uses and applications which do not depart from the spirit and scope of the invention are deemed to be covered by the invention which is limited only by the claims that follow.

What is claimed is:

1. A control system for an automatic pin spotter machine which has electric motor means, a pin deck and filler driven by the electric motor means, a pin spotter, clutch means operatively connected between said electric motor means and said pin spotter to controllably couple said electric motor means to said pin spotter for a complete cycle of said pin spotter, ball cushion means operatively connected to said clutch means which are responsive to the impact of a ball thereon to engage said clutch means, and ball return means, said control system including:

first switch means connected to said clutch means and actuated by the engagement thereof;

second switch means connected to the pin deck and filler and actuated by the condition of the pin deck;

third switch means actuated by a ball impacting the ball cushion means;

fourth switch means actuated by a ball returning on the ball return means;

latch means connected to be latched by actuation of said third switch means and unlatched by actuation of said fourth switch means; and motor control means connected to energize said motor means when said first switch means are actuated, said second switch means are actuated or said latch means are latched.

2. The control system defined in claim 1 including bypass switch means having at least two positions, said bypass switch means being connected to energize said motor control means when in a selected one of the two positions.

3. The control system defined in claim 1 wherein said third switch means include means to produce only one actuation everytime the ball impacts the ball cushion means.

4. The control system defined in claim 3 wherein said third switch means include:

a lever arm operatively connected to the ball cushion means and supported to move upon impact of the ball with said ball cushion means;

a pivoted link biased to a first position and having a second position;

a third switch means switch having actuated and nonactuated positions;

means connecting said pivoted link to said third switch means switch so that when said pivoted link is in its first position, said third switch means switch is in its nonactuated position and when said pivoted link is in its second position, said third switch means switch is in its actuated position; and a paddle pivoted to said pivoted link and having a first paddle position with respect to said pivoted link in which rotation thereof is restrained about said paddle pivot in a first predetermined direction only, said paddle being positioned to be rotated by motion of said lever arm to transfer said motion to said pivoted link to move said pivoted link to its second position when said paddle is rotated in said first predetermined direction and said paddle is in said first paddle position.

5. The control system defined in claim 3 wherein said first switch means include:

a first switch; and means connecting said first switch to the clutch means so that said first switch is actuated during clutch means engagement after said clutch means are engaged and is deactuated during clutch means disengagement before said clutch means are disengaged.

6. The control system defined in claims 3 wherein said fourth switch means include:

a ball return lever positioned in the ball return means to be moved when a ball is returned therealong; and a ball return switch connected to said ball return lever to be actuated by movement thereof.

7. The control system defined in claim 6 wherein said first switch means include:

a first switch; and means connecting said first switch to the clutch means so that said first switch is actuated during clutch means engagement after said clutch means are engaged and is deactuated during clutch means disengagement before said clutch means are disengaged.

8. The control means defined in claim 3 wherein said third switch means include:

a lever arm operatively connected to the ball cushion means and supported to more upon impact of the ball with said ball cushion means;

a pivoted link biased to a first position and having a second position;

a third switch means switch having actuated and nonactuated positions;

means connecting said pivoted link to said third switch means switch so that when said pivoted link is in its first position, said third switch means switch is in its nonactuated position and when said pivoted link is in its second position, said third switch means switch is in its actuated position; and a paddle pivoted to said pivoted link and having a first paddle position with respect to said pivoted link in which rotation thereof is restrained about said paddle pivot in a first predetermined direction only, said paddle being positioned to be rotated by motion of said lever arm to transfer said motion to said pivoted link to move said pivoted link to its second position when said paddle is rotated in said first predetermined direction and said paddle is in said first paddle position, said fourth switch means including:

a ball return lever positioned in the ball return means to be moved when a ball is returned therealong; and a ball return switch connected to said ball return lever to be actuated by movement thereof, and said first switch means including:

a first switch; and means connecting said first switch to the clutch means so that said first switch is actuated during clutch means engagement after said clutch means are engaged and is deactuated during clutch means disengagement before said clutch means are disengaged.

9. The control system defined in claims 1 wherein said third switch means include:

a lever arm operatively connected to the ball cushion means and supported to move upon impact of the ball with said ball cushion means:

a pivoted link biased to a first position and having a second position;

a third switch means switch having actuated and nonactuated positions;

means connecting said pivoted link to said third switch means switch so that when said pivoted link is in its first position, said third switch means switch is in its nonactuated position and when said pivoted link is in its second position, said third switch means switch is in its actuated position; and a paddle pivoted to said pivoted link and having a first paddle position with respect to said pivoted link in which rotation thereof is restrained about said paddle pivot in a first predetermined direction only, said paddle being positioned to be rotated by motion of said lever arm to transfer said motion to said pivoted link to move said pivoted link to its second position when said paddle is rotated in said first predetermined direction and said paddle is in said first paddle position.

10. The control system defined in claim 9 wherein said fourth switch means include:

a ball return lever positioned in the ball return means to be moved when a ball is returned therealong; and a ball return switch connected to said ball return lever to be actuated by movement thereof.

11. The control system defined in claim 9 wherein said first switch means include:

a first switch; and means connecting said first switch to the clutch means so that said first switch is actuated during clutch means engagement after said clutch means are engaged and is deactuated during clutch means disengagement before said clutch means are disengaged.

12. The control system defined in claims 1, wherein said first switch means include:

a first switch; and means connecting said first switch to the clutch means so that said first switch is actuated during clutch means engagement after said clutch means are engaged and is deactuated during clutch means disengagement before said clutch means are disengaged.

* * * * *